US005154173A

United States Patent [19]

Aultman

[11] Patent Number: 5,154,173

[45] Date of Patent: Oct. 13, 1992

[54] FOOT SUPPORT

[76] Inventor: James A. Aultman, 105 Clark Dr., Hattiesburg, Miss. 39401

[21] Appl. No.: 412,905

[22] Filed: Sep. 26, 1989

Related U.S. Application Data

[63] Continuation-in-part of Ser. No. 194,448, May 16, 1988, abandoned.

[51] Int. Cl.[5] ..... A61F 5/14

[52] U.S. Cl. ..... 36/154; 128/DIG. 21

[58] Field of Search ..... 128/581, 585, 586, 595, 128/614, 615, 621, DIG. 21, 383

[56] References Cited

U.S. PATENT DOCUMENTS

| | | | |
|---|---|---|---|
| 2,417,852 | 4/1944 | Zerkle | 128/595 |
| 4,183,156 | 1/1980 | Rudy | 128/383 |
| 4,510,699 | 4/1985 | Nakamura et al. | 128/614 |
| 4,517,981 | 5/1985 | Santopietro et al. | 128/581 |
| 4,669,142 | 6/1987 | Meyer | 128/595 |

*Primary Examiner*—Richard J. Apley
*Assistant Examiner*—Lynne A. Reichard
*Attorney, Agent, or Firm*—Alexander F. Norcross

[57] ABSTRACT

A process for creating a foot support, and the support created thereby. The foot support transfers the force of walking uniformly over the surface of the foot from the points of metatarsal contact through the arch to the heel. A mold prepared to match the foot in relaxed configuration is used to cast a positive impression representing the relaxed surface of the bottom of the foot. The positive impression is leveled horizontally by a level across the high points, or contact points on the bottom of the foot. A casting is made, matching this horizontal level; when cured the casting forms the insert of the invention.

6 Claims, 6 Drawing Sheets

A-A

B-B

FOOT SUPPORT

RELATED APPLICATIONS

This application is a continuation-in-part of my copending application Ser. No. 194,448 filed May 16, 1988 for Aultman Load Leveler Foot Support, now abandoned, which is incorporated herein, in full, by reference.

BACKGROUND OF THE INVENTION

This invention relates to foot supports, specifically those supports for alleviating pain in feet, especially those which are either malformed, or have misaligned metatarsal heads.

In the normal foot, the anatomical structure is that the body weight is borne, during walking, on the heel and on the heads of the first and fifth metatarsal.

Foot deformities are known for which specific orthopedic shoes or structures have been suggested to correct the various foot and postural deformities which are known to occur. Within these orthopedic shoes it is known to place arch supports, inlays or similar devices, but the construction of these supports is such that they place concentrated forces on additional weight bearing points in the foot, producing undue stresses and strains on the foot's surface and inducing displacement of bones within the foot, often worsening the natural gait of the individual.

Such structures are shown, for instance, in U.S. Pat. No. 4,803,989 to Collins disclosing a form of rigid, hardened metatarsal pad for the specific purposes of raising the heads of the metatarsals over an area. This pad is fixed in size and shape and of a rigid construction formed for a general human foot. The material of the pad is relatively incompressible.

An alternative form of such support is shown in U.S. Pat. No. 3,545,447 to Silverman. Silverman, while recognizing the deleterious effects of a rigid metatarsal arch support, shows a heel stabilizer, a structure cupping the heel to restrain the foot from expanding under load and which raises the heel of the foot, transferring force "evenly" over the heads of the metatarsals.

In these prior art structures, as in others disclosed in the two patents mentioned, there is an assumption that the positioning of the metatarsal has not been deformed by the unsymmetrical loading which gives rise to foot pain. Where, as is more common, foot pain exists because of malforming of the foot or mispositioning of or growths on the various metatarsal heads, such structures only serve to concentrate the weight of the body on to one or more points of the foot, exacerbating rather than alleviating the problem.

SUMMARY OF THE INVENTION

I disclose a process for creating a foot insert, and the foot insert created by the process, which is particularly adapted to alleviating the pain and misposturing of a foot having a deformed aspect due to a collapse, falling, or misalignment of one or more metatarsal heads. Unlike the prior art, my foot insert is specifically constructed so as to transfer the force of walking imposed upon the base of the foot uniformly over the surface of the foot from the points of metatarsal contact through the arch to the heel. The insert produced by the process of my invention thus removes and alleviates the concentrated point loading which is the cause of metatarsal head mispositioning.

The insert of my invention is created by the following process, in summary form. The individual foot to be fitted is placed in approximately a horizontal position and pressed halfway into a molding mixture, such as Plaster of Paris, to create a first or initial mold. This mold will represent the foot in a relaxed configuration, without pressure being exerted upon the surface of the foot. The mold is then prepared for casting and is used to cast a second, positive impression, representing the articulation of the surface of the foot under a condition of no pressure. This positive impression will be rounded as is the base of the foot and will, in fact, look like the specific foot being molded in an upside-down position.

The resulting positive impression, representing the actual formulation of the surface of the base of the individual foot, is then levelled horizontally by using a spirit level across the high points of the impression, which represent the contact points of the base of the foot. A flexible plastic strip or dike is then wrapped around the edges of this positive impression and levelled to the same high points forming a second mold. Any one of a number of means can be used to hold this flexible plastic strip tightly against the mold so as to accurately delineate the edge of the foot; the most satisfactory being to pack the plastic strip in place with molding clay against the outline of the foot as shown by the positive impression. A casting is then made of silicone rubber up to the level of the flexible plastic strip, which represents the horizontal level defined by the contact points of the foot. The levelling process insures that this silicone rubber covers all but these contact points or high points. The resulting silicone rubber insert, when cured, forms the foot insert of the invention. The only remaining required processing is that the specific insert is trimmed to fit in a specific shoe for the individual concerned.

It can readily be seen that the process may be repeated for a given individual's foot so as to provide a customized insert for each shoe owned by the individual.

The use of silicone rubber is specified in that the insert requires a material having no chemical reactivity in the presence of the normal sweat and oil given off by the foot and the materials normally found in a shoe. Further, the material must be nonirritating to the human skin and must not give off byproducts that are acidic or otherwise irritating. More importantly, the material of the insert must combine a relatively high tear resistance and strength with a uniform compressibility so that loads applied to the material are evenly distributed through the material against the surface of the foot.

As a result, with an insert made by the process inserted in the shoes, the individual, when walking will find that the forces, formerly concentrated on the misaligned metatarsal heads are now instead distributed through the insert uniformly against the base of the foot. This has the effect of unloading the metatarsal heads and alleviating the pain that the individual otherwise will suffer from undue concentration of foot forces on metatarsal heads.

Since malformation of the metatarsal heads is in many cases the foot's natural response to bad posture or to pain and undue pressure against certain points of the foot, the insert of the invention relieves this excessive pressure, preventing further damage to the foot, and, under the appropriate circumstances, causing the foot to resume a more natural posture.

It can readily be seen that the insert differs from those of the prior inventions in that rather than loading or attempting to load an assumed position of the metatarsal heads, each insert is adapted to the actual structure of the individual foot concerned so as to provide uniform pressure loading across the entire arch of the foot from the metatarsal heads back to the heel of the foot. The rigid arches of the prior art serve only to reposition the pressure loading within the foot, causing further damage. Further, where an individual has a fallen metatarsal head not anticipated by the standard bulge of the prior rigid arches, excessive pressure is brought to bear on this head by the prior arch supports, exacerbating the foot problems.

It can thus be seen that the invention provides an easy process for making an individuated insert that unloads the pressure points on the base of the foot by more evenly distributing the forces of walking across the entire surface of the foot.

It is thus an object of this invention to show a form of shoe insert which alleviates pain from walking in the foot of one who has a deformed foot or a misaligned metatarsal head.

It is a further object of this invention to disclose a form of insert which reduces concentrated pressure loading on points on the surface of the foot in both the normal and the abnormally shaped foot.

It is a further object of this invention to disclose a process for creating a shoe insert for providing a uniform surface loading over the base of the foot.

It is a further object of this invention to show a process for creating a shoe insert which provides specific orthopedic support for a malformed foot.

These and other objects of the invention may be more clearly seen from the detailed description of the preferred embodiment which follows.

DETAILED DESCRIPTION OF THE PREFERRED EMBODIMENT

Figure 1:
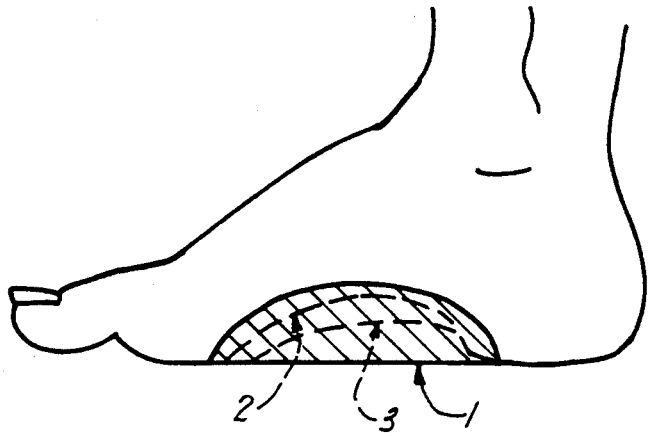
FIG. 1 shows the inside view of the right foot with Type "A" Aultman Load Leveler Foot Support in place.
Figure 2:
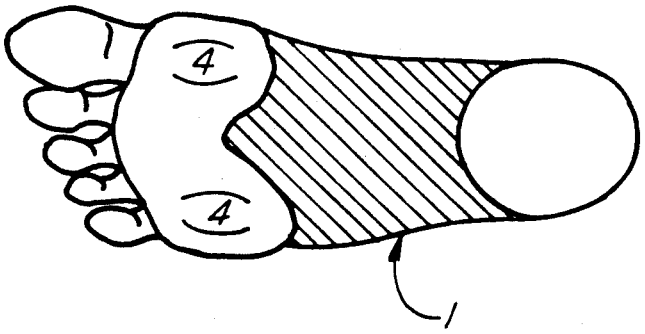
FIG. 2 shows the bottom view of the right foot with Type "A" Aultman Load Leveler Foot Support in place and typical stress areas shown.
Figure 4:
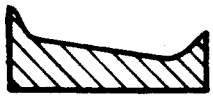
FIG. 4 is a cross-sectional view of transverse cut through Type "A" Aultman Load Leveler Foot Support of the left foot.
Figure 3:
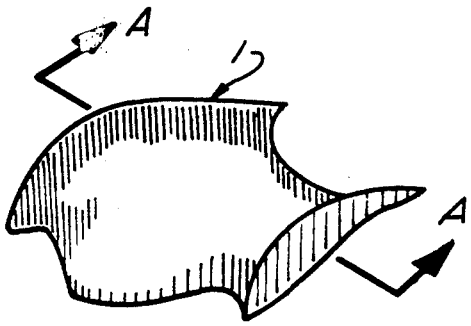
FIG. 3 is an upper right hand perspective view of Type "A" Aultman Load Leveler Foot Support for left foot.
Figure 5:
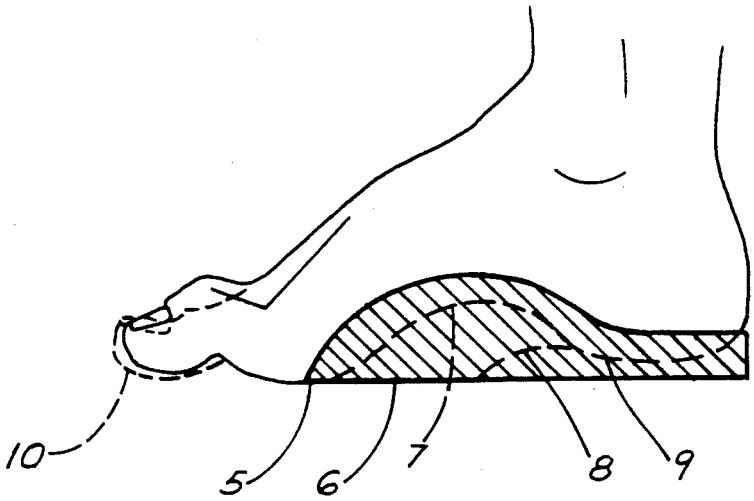
FIG. 5 shows the inside view of the right foot with Type "B" Aultman Load Leveler Foot Support in place.
Figure 6:
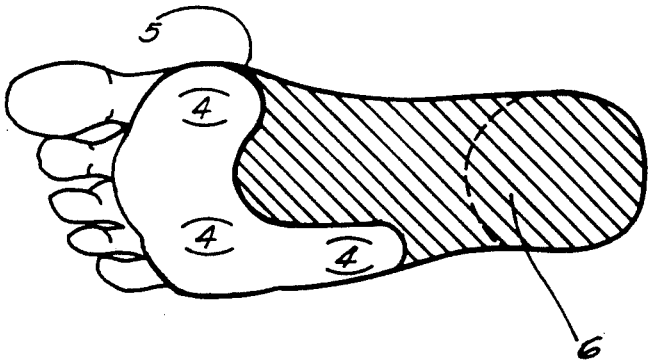
FIG. 6 shows the bottom view of the right foot with Type "B" Aultman Load Leveler Foot Support in place and typical stress areas shown.
Figure 8:
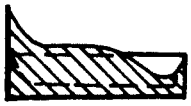
FIG. 8 is a cross-sectional view of transverse cut through Type "B" Aultman Load Leveler Foot Support of the left foot.
Figure 7:
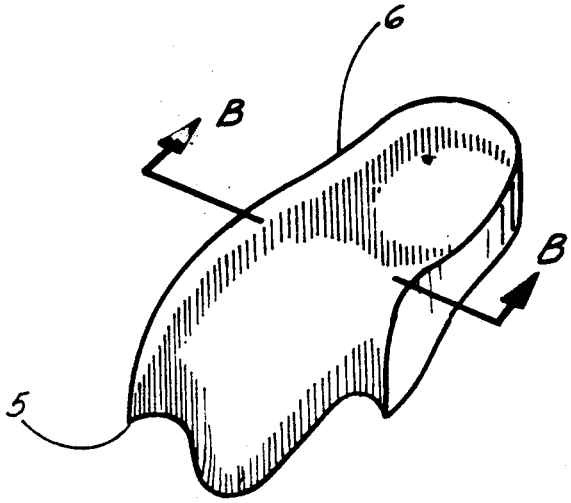
FIG. 7 is an upper right hand perspective view of Type "B" Aultman Load Leveler Foot Support for the foot.
Figure 9:
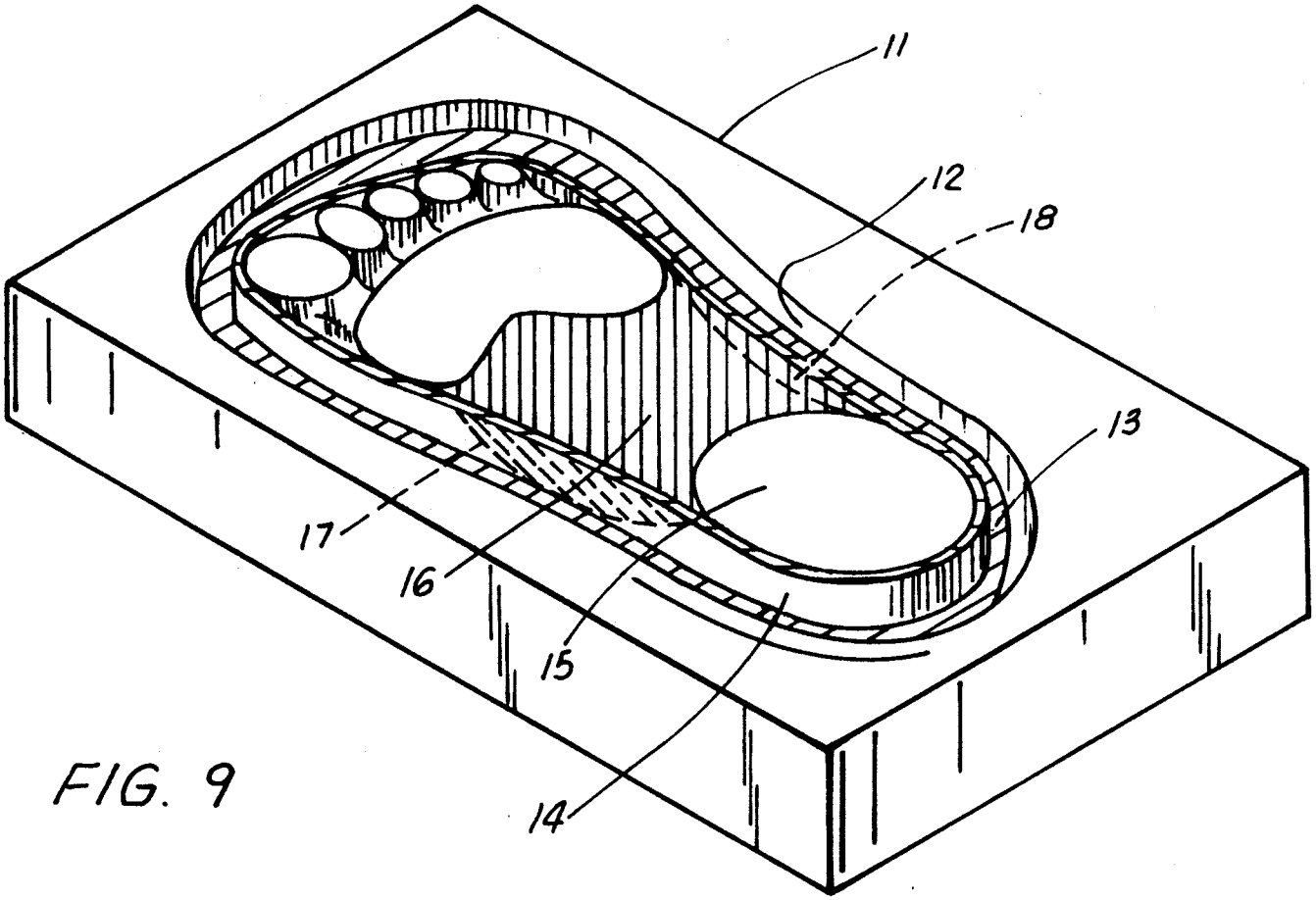
FIG. 9 is an assembly drawing showing how Aultman Load Leveler Foot Support is molded.
Figure 10:
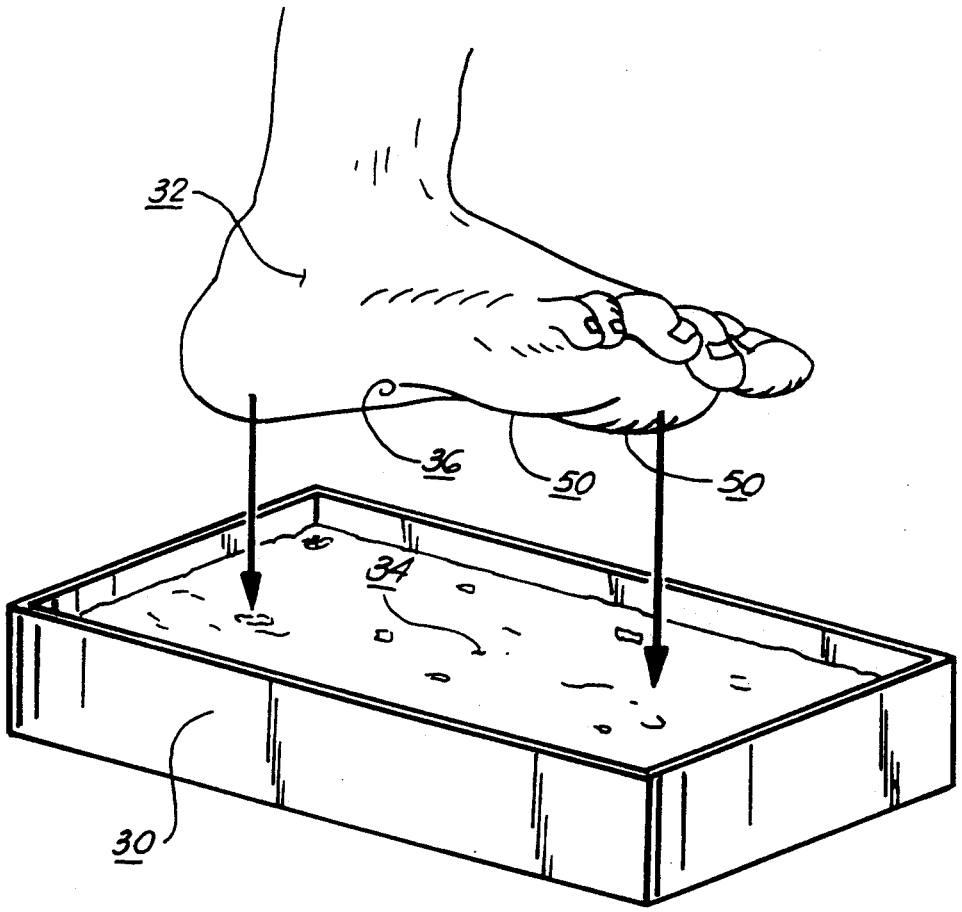
FIG. 10 is an oblique depiction of the process of making the first mold of the invention.
Figure 11:
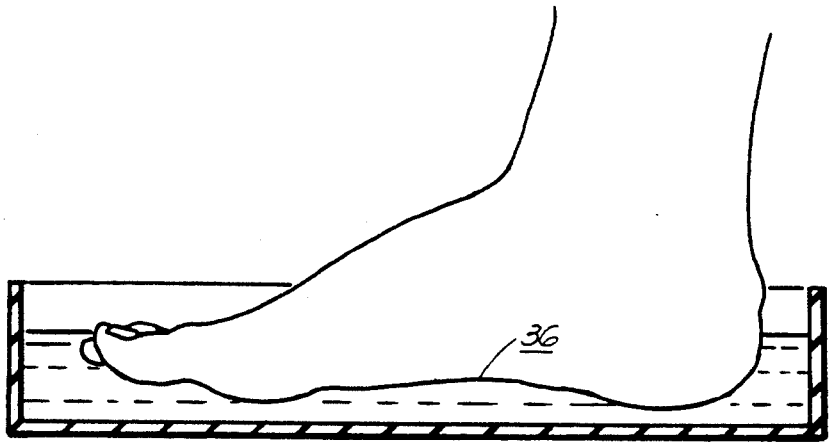
FIG. 11 is a section view of the foot as partially inserted within the mold making medium for making the first mold.
Figure 12:
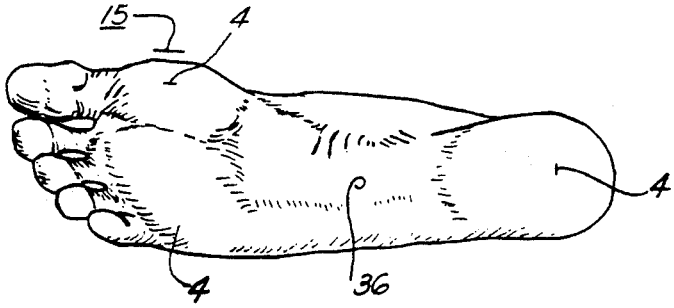
FIG. 12 is a depiction of the positive or second mold in the process of the invention.
Figure 13:
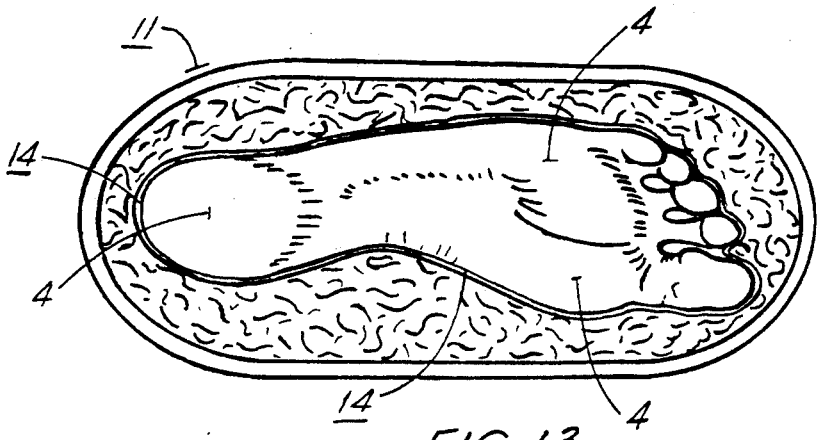
FIG. 13 depicts the positioning of the positive mold within an enclosed boundary plastic strip.
Figure 14:
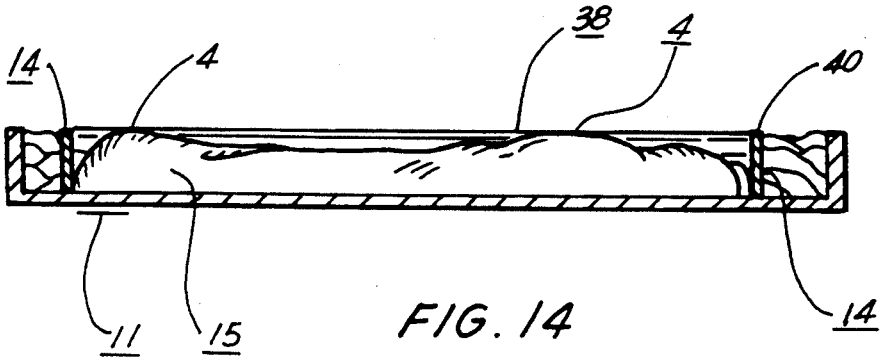
FIG. 14 is a side section view of the positive mold as sectioned with the strip showing the levelling.
Figure 15:
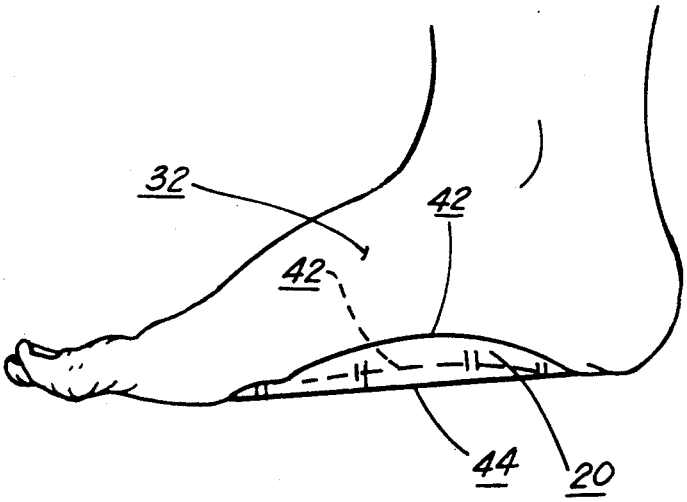
FIG. 15 shows the foot support insert of the invention under the foot.
Figure 16:
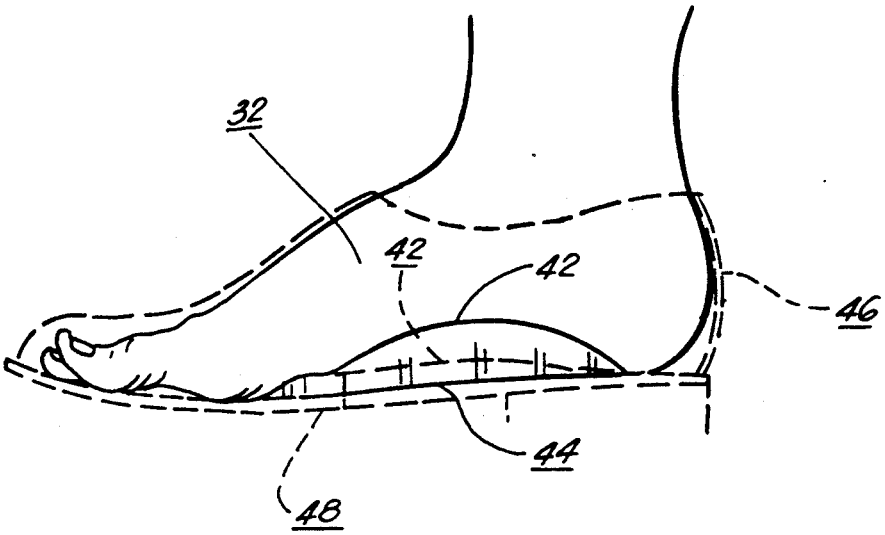
FIG. 16 shows the foot support insert of the invention inserted within a shoe.

The article of the invention, the therapeutic foot insert 20 is best defined by describing the process for its creation, which process uniquely determines the shape of the insert 20.

Referring to the figures for illustration, the insert 20 is created by first creating a first mold 30 representing an impression of an unloaded foot 32. Foot 32, the individual foot for which the insert 20 is to be created, is inserted in a generally horizontal position into a container of Plaster of Paris 34 or any similar mold making compound 34. The foot 32 is inserted into the mold making compound 34 approximately halfway, a distance sufficient to make an impression of the bottom surface 36 of the foot, but without such pressure as would deform the unloaded contour of the bottom surface 36 of the foot.

First mold 30 having been made, it is prepared for casting, by allowing it to harden and then spraying it with a suitable separation material, as is well known in the art for coating molds for making a cast.

A positive casting 15 is then created representing the bottom surface (sole) 34 of the unloaded foot, using any suitable casting medium, such as plaster, casting it into first mold 30. The creation of first mold 30 insures that casting 15 will represent accurately the exact contouring shape of the bottom of an individual foot 32. Thus casting 15 will have, and accurately will represent any deformations or points of unusual stress 4 existing on the sole 34 of the foot 32

An insert making die 11 is then created from casting 15 by the following process. First, casting 15 is levelled, with a hand level (not shown) to a gravitationally level position by levelling all of the stress points 4 on the sole of the foot to an even height or tangent plane 38. As previously noted in my prior patent, sometimes the heel will be one of these stress points it is points and sometimes desirable that the heel be offset by a certain amount from this tangent plane 38 which represents the desired plane of contact of the bottom surface 36 of the foot with the walking surface during walking.

Casting 15 is supported in this level position by any of a number of means, such as by using clay or similar supporting medium. Casting 15 is then converted into die 11 by closely enclosing casting 15 within a curved dike 14. Curved dike 14 is preferably a thin plastic strip which can be readily formed against the outer surface of the casting 15, forming an enclosure around casting 15. Dike 14 is levelled by bringing its upper edge 40 to the same tangent plane 38 as the chosen stress points 4.

It is typically found in the normal foot that the desired stress points 4 are the first and fifth metatarsal and the heel of the foot. However, in a foot which has been malformed due to unusual stress or in which the patient has experienced considerable pain, it is often found that other stress points 4 have formed due to a falling of or growths on one or more metatarsal heads. It is, therefore, important that these stress points 4 be accurately identified by an examination of the patient by a suitably qualified orthopedic medical examination so as to correctly identify those points experiencing direct contact and stress during walking. This medical examination will also indicate and reveal whether the corrected insert should raise the heel by spacing the heel a distance below tangent plane 38.

Die 11 having been prepared by gravitationally levelling casting 15 and dike 14, the insert 20 is then created by pouring a suitable insert material in die 11 and allowing it to harden to form the insert.

The proper material for insert 20 must meet the following requirement. First, it must initially be a soft material, as a patient typically requiring an insert 20 is experiencing extreme pain in walking and will have very tender feet. After some treatment, it will be found that the patient's foot will gradually reform to a more normal condition, and a harder insert material, relatively speaking, may then become more appropriate. However, in all cases the insert material must be sufficiently compressible that a uniform load transfer will occur across the upper surface 42 of the insert. It is desirable that the material have a Durometer hardness of less than 40, measured by ASTM Standard D176, Shore A, in points.

Although the insert must be of a compressible material as explained above, it must also be impermeable. A porous or permeable material will rapidly absorb sweat and oils from the body and will provide a medium for the growth of bacteria and fungus. This is unacceptable, and therefore the insert material must be impermeable and washable so that it may be maintained in a clean, if not sterilized, configuration. Additionally, in order to provide adequate wear under body loading the material must have a relatively high tear strength. Finally, it must be a chemically inert material; it should not give off, or itself be, either acid or alkaline, nor should it emit any vapors or liquids which may be irritating to the foot under normal conditions of wear, body heat, and exposure to body emissions such as sweat or skin oils.

To the knowledge of the inventor, the only material which meets the above requirements are the materials generically known as silicone rubbers, and of the silicone rubbers a preferred material is Silastic brand HS RTV Moldmaking silicone rubber, manufactured by the Dow Corning Corporation of Midland, Michigan.

Throughout the above description the inventor has used the phrase gravitationally levelled to refer to the horizontal levelling of tangent plane 38, established between the stress points 4 and the upper edge 40 of the dike. It should be apparent that, in casting insert 20, this tangent plane 38 defines the lower surface 44 of the insert 20, as the casting material flows and sets according to gravity; this therefore requires that the die 11 be gravitationally level.

The insert 20 having been created by the process above described, of the materials described, it is then trimmed to fit an individual's shoe 46 and inserted along the base or innersole 48 of the shoe. The lower surface 44 of the insert thus is in direct contact with the sole 48 of the shoe. The upper surface 42 of the insert, by reason of the process of making the insert 20, provides a uniform contact with the bottom surface 36 of the foot under an unloaded condition.

The primary loading that affects the surface of the malformed foot is not an impact loading in walking, such impact loading being directly and primarily concentrated in the heel, but rather a constantly rolling pressure as the foot rolls through the walking step from heel contact through full pressure upon the metatarsals as the body moves forward across the foot. The insert 20 transmits these forces from the sole of the shoe uniformly to the bottom surface of the foot. By reason of its uniform compressibility, it causes the pressures arising through the sole of the foot to be uniformly distributed across the bottom surface of the foot rather than being concentrated on the stress points 4 of the foot. Thus the insert 20 acts to unload or to reduce the pressure on the protruding metatarsal heads 50 which create the stress points 4 and which are the source of pain and discomfort. In turn, the metatarsal heads 50, having so been unloaded, are less irritated by the forces of walking, and the lessening of this irritation stops the compensating process of spur growth and bone movement which otherwise exacerbates the problem of the development of stress points within the foot and the creation of pain within the malformed foot.

It should thus be seen that the process of the invention describes a specifically created insert, individuated to a specific foot, which provides a uniform support to the surface of the foot, unloading the metatarsals and creating a more uniform and natural pressure pattern across the base of the foot. The insert is principally effective for support of malformed feet which cannot be properly supported by the rigid, nonindividual metatarsal supports of the prior art; it is however, equally effective in the support of any foot and has been observed to increase comfort and decrease pain from standing or walking in substantially all patients.

A specific insert has been, of necessity, depicted in the figures. No limitations are to be inferred as to the shape of the insert from this one illustration, and the invention extends to those equivalent forms as are inherent in the claims.

I claim:

1. An insert supporting the sole of a foot within a shoe comprising:

a unitary, impermeable, inert, compressible lining having a defined top surface and a defined bottom surface;

said top surface being individually shaped to the contour of an individual foot, said top surface being individually shaped to the contour of an individual, relaxed, unloaded foot;

said top surface contactingly supporting said foot at least between the metatarsal heads and the heel thereof;

said bottom surface being defined as a plane tangent to one or more points of high stress on the bottom of said foot;

having a durometer hardness less than 40 points and high tear strength.

2. The apparatus of claim 1 above wherein said insert on top surface supportingly contacts said foot from a position adjacent the metatarsal heads thereof to the rear of the foot, spacing the heel thereof a distance from the sole of said shoe.

3. The apparatus of claim 1 above wherein support further comprises: said insert being cast of an inert, compressible, impermeable material having a durometer hardness less than 40 points and high tear strength.

4. An apparatus for alleviating concentrated loading and stress on one or more known points of high stress of the bottom surface of an individual's foot comprising:

a casting, of an inert, compressible, impermeable material having a durometer hardness less than 40 points and high tear strength, without voids, having an upper surface conformed to uniformly contact the bottom surface of the foot, said upper surface conformed to uniformly contact the bottom surface of the foot in an unload standing posture;

conforming said casting bottom surface to be coplanar with a planar surface tangent to the known points of high stress 5. The apparatus of claim 4 wherein said planar surface is spaced a distance from the heel of the foot.

6. A process for creating a prosthetic support for an individual having excess concentrated stress on specific defined points of the bottom surface of the individual's foot, comprising:

making an impression mold of the foot, in a standing posture under a downward pressure representing substantially no load on the foot;

making a negative cast from said impression mold, said casting representing the bottom surface of the foot, having edges representative of the outer edges of the foot;

defining, on said negative cast, a tangent plane tangent to all the said specific defined points;

positioning said negative cast, by levelling said tangent plane to a horizontal position;

forming a die from said positioned negative case enclosing it in a dike, a flexible strip contactingly positioned around the perimeter of said negative cast;

said strip defining an upper edge thereof, levelling said upper edge to said tangent plane;

casting, with an impermeable, inert, compressible material, having high tear strength and a durometer hardness less than 40 points in said die, a foot support having a bottom surface co-planar with said tangent plane and an upper surface conforming to said negative cast.

* * * * *